US005334070A

United States Patent [19]

Yu et al.

[11] Patent Number: 5,334,070

[45] Date of Patent: Aug. 2, 1994

[54] TETHERED CONTROLLED FLYING TOY

[75] Inventors: Yiu K. Yu, Shatin; Bryan K. F. Au, Kowloon, both of Hong Kong

[73] Assignee: Uni-King Toys Ltd., Kwun Tong, Hong Kong

[21] Appl. No.: 50,520

[22] Filed: Apr. 20, 1993

[51] Int. Cl.[5] ..... A63H 27/04; A63H 27/127; A63H 27/00

[52] U.S. Cl. ..... 446/31; 446/36; 446/232

[58] Field of Search ..... 446/7, 30, 31, 32, 33, 446/34, 36, 37, 56, 57, 66, 176, 178, 211, 230, 232; 244/3

[56] References Cited

U.S. PATENT DOCUMENTS

| | | | |
|---|---|---|---|
| 2,292,416 | 8/1942 | Walker . | |
| 2,439,054 | 4/1948 | Mosthof . | |
| 2,558,109 | 6/1951 | Stanzel | 446/32 |
| 2,743,068 | 4/1956 | Walker . | |
| 2,779,595 | 1/1957 | Ensley | 446/30 X |
| 2,801,494 | 8/1957 | Ernst | 446/37 |
| 2,992,512 | 7/1961 | Pettit | 446/37 X |
| 3,110,126 | 11/1963 | Kretzmer, Jr. . | |
| 3,165,861 | 1/1965 | Stanzel | 446/37 |
| 3,579,905 | 5/1971 | Radford et al. . | |
| 3,705,720 | 12/1972 | Nicholls . | |
| 3,999,328 | 12/1976 | Schroeder . | |
| 4,037,358 | 7/1977 | Rosenbaum . | |
| 4,133,139 | 1/1979 | Stenzel | 446/31 |
| 4,805,853 | 2/1989 | Battles . | |
| 4,825,136 | 4/1989 | Farhat . | |
| 4,981,456 | 1/1991 | Sato et al. | 446/36 |
| 5,106,344 | 4/1992 | Jancso, Jr. . | |

FOREIGN PATENT DOCUMENTS

| | | | |
|---|---|---|---|
| 1024861 | 2/1956 | Fed. Rep. of Germany | 446/37 |
| 2006520 | 8/1971 | Fed. Rep. of Germany | 446/37 |

OTHER PUBLICATIONS

Life-Like Gliders packaging card.

*Primary Examiner*—Robert A. Hafer
*Assistant Examiner*—D. Neal Muir
*Attorney, Agent, or Firm*—Hedman, Gibson & Costigan

[57] ABSTRACT

The present invention relates to a tethered controlled flying toy that is attached to a control unit by a hollow tube and a clutch assembly. A rotating cable extends from a motor within the control unit through the clutch assembly and the hollow tube to the flying toy where it attaches to the propeller of the flying toy. The rotating cable is rotated by the motor that in turn causes the propeller of the flying toy to rotate and the flying toy to become airborne. The present invention can be used in confined spaces and simulates many the aerodynamics of true flight.

12 Claims, 4 Drawing Sheets

TETHERED CONTROLLED FLYING TOY

FIELD OF THE INVENTION

This invention relates to a tethered controlled flying toy that is suitable for indoor or outdoor use.

BRIEF DESCRIPTION OF THE RELATED ART

Tethered controlled aircraft have been known for sometime. Some tethered controlled aircraft are powered by gasoline engines such as those described in U.S. Pat. Nos. 2,292,416, 2,743,068 and 3,110,126. The gasoline powered aircraft usually require at least two individuals for operation, one individual to operate the controls and another individual to start the engine and assist in launching the aircraft. The gasoline powered aircraft have the further disadvantage of requiring a large clear open space for operation due to the circular flight path of the aircraft, the noise of the engine, the oil and fuel leakage associated with the engine and the high uncontrolled speeds at which the aircraft operates.

As electric motors evolved, it became possible to incorporate the smaller and more efficient electric motors into tethered controlled aircraft. In order to insure that these electric motors produced enough power to lift the model aircraft, the power source is usually located on the ground or on the operator as described in U.S. Pat. No. 2,439,054, 3,579,905 and 5,104,344. The electric power for the tethered controlled aircraft is generally supplied to the on board electric engines through the same pair of wires used to control the aerodynamics of the aircraft.

As with the gasoline powered tethered controlled aircraft, a large open or unobstructed area is required to operate the electric tethered controlled aircraft due to the circular flight path of the aircraft.

Nicholls, U.S. Pat. No. 3,705,720 teaches a tethered controlled electric powered aircraft that can be operated in a limited space but with the limitation of a circular flight path. Nicholls teaches a model aircraft that flies about a pylon. The aircraft is linked to the pylon by two flexible wires, one which is used to drive the propeller of the aircraft and the other to adjust the elevator control. The operator controls the speed and height of the circular flight path from a remote location.

SUMMARY OF THE INVENTION

It is an objective of the present invention to provide an electrically powered tethered controlled flying toy that can be operated in a confined space.

It is a further objective of the present invention to more accurately simulate the aerodynamics of flight by allowing the operator to control the speed of the propeller, the altitude of the flying toy and the directional path of the flying toy.

The above-mentioned objectives are achieved in the present invention by attaching a tethering means to the rear of the flying toy, rather than the side of the flying toy as taught by the prior art. Attaching the tethering means to the rear of the aircraft restrains the flying toy in only the forward direction thereby allowing for a greater range of potential movement.

The present invention comprises a flying toy, such as an airplane or helicopter, a control means, a hollow tethering means that attaches the flying toy to the control means, a rotating tethering means for rotating the propeller of the flying toy and a clutch assembly that attaches the hollow tethering means to the control means.

The clutch assembly allows the orientation of the hollow tethering means to be adjusted prior to or during flight. The ability to adjust the hollow tethering means overcomes the problem of a twisted tether cord that may result in poor control of the flying toy and/or poor delivery of power to the propeller.

The control means comprises a power source, a motor that rotates the rotating tethering means, a means to rotate the hollow tethering means about the central axis of the control means, a means for moving a hollow, tethering means in a direction parallel to the central axis of the control means and a housing.

The flying toy is attached to the end of the hollow tethering means opposite the control means.

The rotation of the hollow tethering means in a clockwise direction with respect to the central axis of the control means, causes the flying toy to move to the right of the central axis of the control means while rotation of the hollow tethering means in a counter clockwise direction with respect to the central axis of the control means, causes the flying toy to move to the left of the central axis of the control means.

The movement of the hollow tethering means in a direction that is parallel to the central axis of the control means causes different functions depending on the type of flying toy attached to the hollow tethering means. For example, if the flying toy attached to the hollow tethering means is a helicopter, the movement of the hollow tethering means in a direction parallel to the central axis of the control means can be used to control a means for the helicopter to releasably carry a payload. If the flying toy attached to the hollow tethering means is an airplane, the movement of the hollow tethering means in a direction parallel to the central axis of the control means can be used to control the angle of the wings of the airplane and thereby the altitude of the airplane during flight.

DETAILED DESCRIPTION OF THE INVENTION

The present invention will be better understood by the following detailed description of a preferred embodiment of the invention and with reference to the drawings.

The present invention comprises a flying toy, a control means 1, a hollow tethering means 30, a rotating tethering means 6 and a clutch assembly 5.

Figure 1:
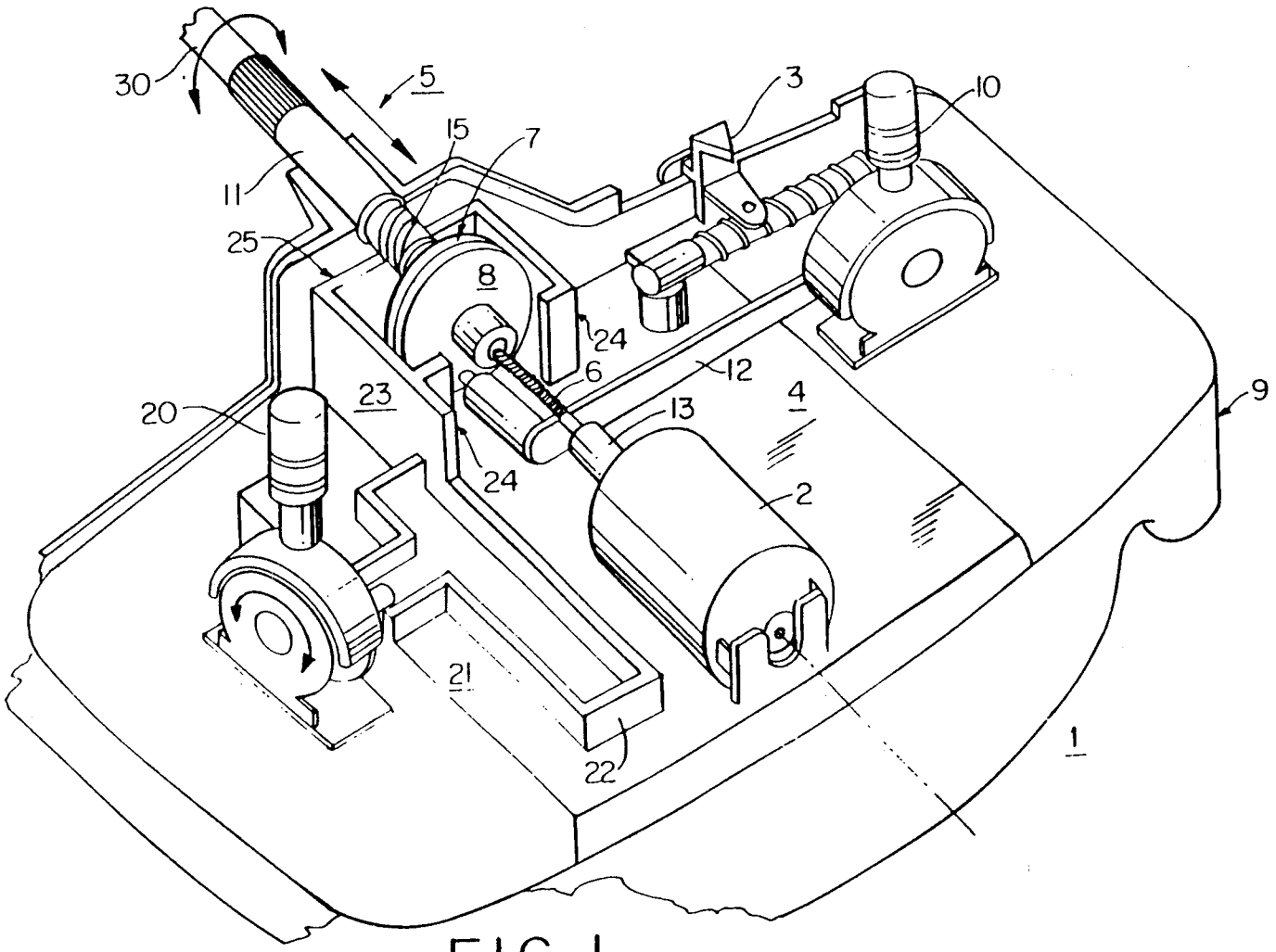
FIG. 1 is a top cross sectional view of a preferred embodiment of the control means.

FIG. 1 is a top cross sectional view of a preferred embodiment of the control means 1. The control means 1 comprises a power source (not shown), a motor 2, a switch 3, a means for rotating a hollow tethering means about the central axis of the control means 4 comprising lever 10 and arm 12, a means for moving the hollow tethering means in a direction parallel to the central axis of the control means 21 comprising lever 20, arm 22 and clutch surrounding structure 23, and a housing 9.

The housing 9 for the control means 1 is preferably made of plastic and designed to be easily held in the hands of the operator. A preferred embodiment is about 10 to about 15 centimeters in length, about 5 to about 15 centimeters in width and about 5 to about 10 centimeters in height.

The power source can be any type of electric source commonly used in the industry such as a dry cell battery. In a preferred embodiment of the present invention the power source is four 1.5 volt, size AA, batteries connected in series. Preferably the power source is located within the central region of the control means 1 below motor 2 and is accessible by a removable panel located on the bottom of housing 9.

The power source supplies power to motor 2. The amount of current that flows from the power source to motor 2 is controlled by a switch 3. Switch 3 can a simple switch that merely opens or closes the electric circuit between the power source and motor 2.

It is preferred that switch 3 be a variable resistance type switch as shown in FIG. 1. A variable resistance switch will allow the operator to control the amount of current that flows to motor 2 and thereby control the speed at which motor 2 operates. Control of the speed of motor 2 is important because it allows the operator of the present invention to control the speed of the propeller of the flying toy.

Motor 2 may be any type of motor commonly used in the toy industry. In a preferred embodiment of the present invention motor 2 is a six (6) volt (RC-280R-2485) MABUCHI TM motor, commercially available from, Mabuchi Industry Co., Ltd., Hong Kong.

Motor 2 is connected to the rotating tethering means 6 by any means commonly known in the industry. In a preferred embodiment the rotating tethering means 6 is connected to motor 2 by a connecting sleeve 13, which is preferably made of copper.

The rotating tethering means 6 may be a plastic, metal or fiber cable that runs through a centrally disposed opening of the clutch assembly 5, through the centrally disposed opening of the hollow tethering means 30 and the hollow connecting tube 45 of the flying toy before attaching to the propeller of the flying toy. The rotating tethering means 6 is rotated by motor 2 which in turn causes the propeller of the flying toy to rotate.

It is preferred that the rotating tethering means 6 be a multi strand 1×700.8 S twist gauge metal cable about 0.5 to about 1.5 meters in length, of the type commercially available from Shinyo Rope under the tradename Shinyo.

Clutch assembly 5 connects the hollow tethering means 30 to the control means 1. As seen in FIG. 1 clutch assembly 5 is comprised of a shaft 11 with a forward clutch plate 7 attached to shaft 11, a spring 15 and a rear clutch plate 8. Rear clutch plate 8 has a centrally disposed opening through which shaft 11 passes. Rear clutch plate 8 is attached to lever 10 by arm 12.

Figure 4:
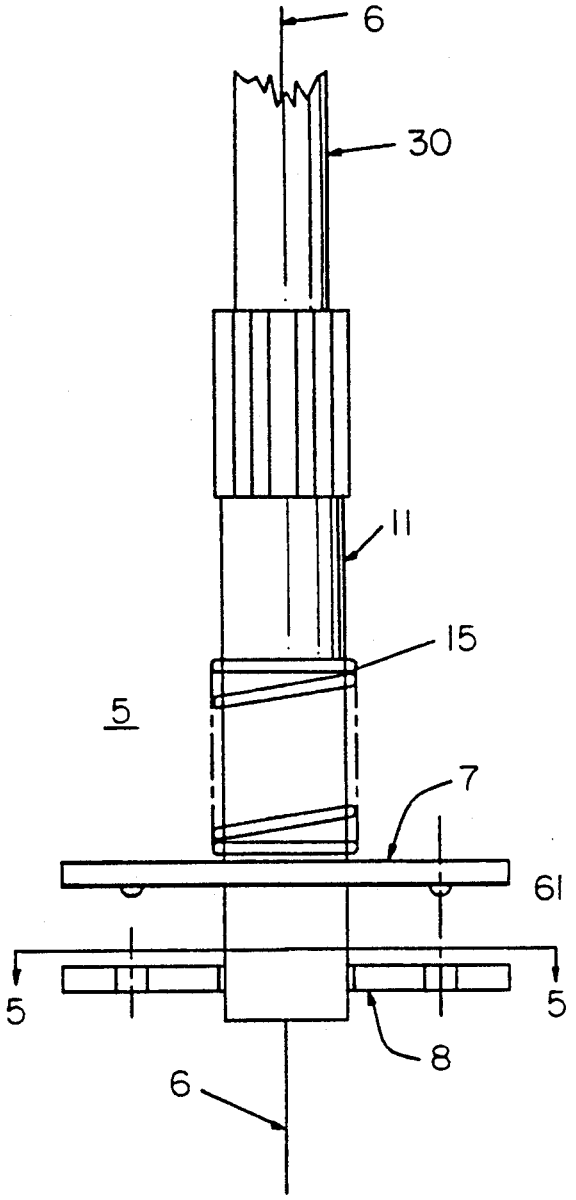
FIG. 4 is an expanded top view of the clutch assembly.
Figure 5:
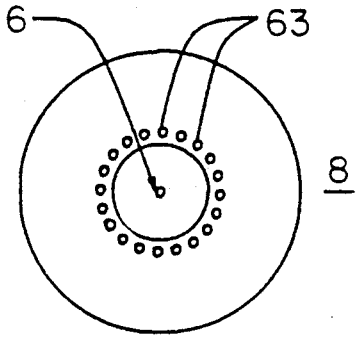
FIG. 5 is a cross sectional view of the clutch assembly of FIG. 4 taken along line 5—5.

Shaft 11 extends outwardly from the control means 1 along the central axis of the control means 1 and has a centrally disposed opening through which the rotating tethering means 6 passes. As seen in FIGS. 4 and 5 the forward clutch plate 7 has at least one protrusion 61, preferably two or more, located on the surface of the clutch plate that faces the surface of the rear clutch plate 8. The protrusion 61 is strategically located and sized to interact with any of a plurality of recesses 63 that are circumferentially arranged on the face of the rear clutch plate 8 that faces the forward clutch plate 7.

Spring 15 forces the forward clutch plate 7 into contact with the rear clutch plate 8. The interaction of spring 15, protrusion 61 and recess 63 allows clutch assembly 5 to move as a single unit unless an outside force compresses spring 15. If spring 15 is compressed, protrusion 61 disengages from recess 63 allowing shaft 11 and forward clutch plate 7 to move independently of rear clutch plate 8. Moving shaft 11 and forward clutch plate 7 independently of rear clutch plate 8 allows the operator to adjust the orientation of clutch assembly 5 and thereby the orientation of the attached hollow tethering means 30.

The portion of shaft 11 that extends outwardly from the control means may contain a series of indentations. These indentations facilitate gripping of the shaft 11 by the fingers of the operator when the operator adjusts the orientation of clutch assembly 5.

Clutch assembly 5 attaches to lever 10 by way of arm 12 that is attached to rear clutch plate 8. The movement of lever 10 to the left causes arm 12 to move away from the central axis of the control means 1 and thereby rotate clutch assembly 5 in a counter clockwise direction. Similarly the movement of lever 10 to the right causes arm 12 to move toward the central axis of the control means 1 and thereby rotate clutch assembly 5 in a clockwise direction.

The rotation of clutch assembly 5 causes the hollow tethering means 30 to rotate in the same direction as clutch assembly 5. The rotation of the hollow tethering means 30 allows the direction of the flying toy to be controlled by the operator as will be described in detail below.

Clutch assembly 5 is also moveable in a direction parallel to the central axis of the control means 1. The clutch assembly 5 is connected to lever 20 by way of arm 22. The forward clutch plate 7 and the rear clutch plate 8 of clutch assembly 5 rest in the clutch surrounding structure 23 that is attached to arm 22. When lever 20 is moved toward the rear of the control means 1, arm 22 moves toward the front of the control means 1, causing the clutch surrounding structure 23 to move toward the front of the control means 1. As the clutch surrounding structure 23 moves toward the front of the control means 1, walls 24 of the clutch surrounding structure 23 contact the rear clutch plate 8 and push clutch assembly 5 forward.

Similarly when lever 20 is moved toward the front of control means 1, arm 22 moves toward the rear of the control means 1, which in turn causes the clutch surrounding assembly 23 to move towards the rear of the control means 1. As the clutch surrounding structure 23 moves toward the rear of the control means 1, wall 25 of the clutch surrounding structure 23 contacts the forward clutch plate 7 and pushes clutch assembly 5 toward the rear of the control means 1.

In a preferred embodiment levers 10 and 20 are spring loaded to insure that they return to a normal position when no force is applied to the levers by the operator.

Extending from the portion of shaft 11, that extends from the control means 1, is the hollow tethering means 30. The hollow tethering means 30 may be any type of hollow conduit structure commonly known in the art. It is preferred that the hollow tethering means 30 be a plastic tube of about 0.5 to about 1.5 meters in length with an outer diameter of about 3.5 mm and an inner diameter of about 1.5 mm. Plastic tubes having these preferred dimensions are commercially available from Lee Shing Industrial Co.

The hollow tethering means 30 extends from shaft 11 to the flying toy. The flying toy can be any type of toy such as an airplane as shown in FIG. 2 or a helicopter as shown in FIG. 3.

If the flying toy is an airplane the hollow tethering means 30 should attached to the rear of the airplane at an angle Θ to insure the airplane exhibits top flying performance. The angle Θ should be about 10° to about 45°, preferably about 15° to about 25° and most preferably about 20°.

Figure 2:
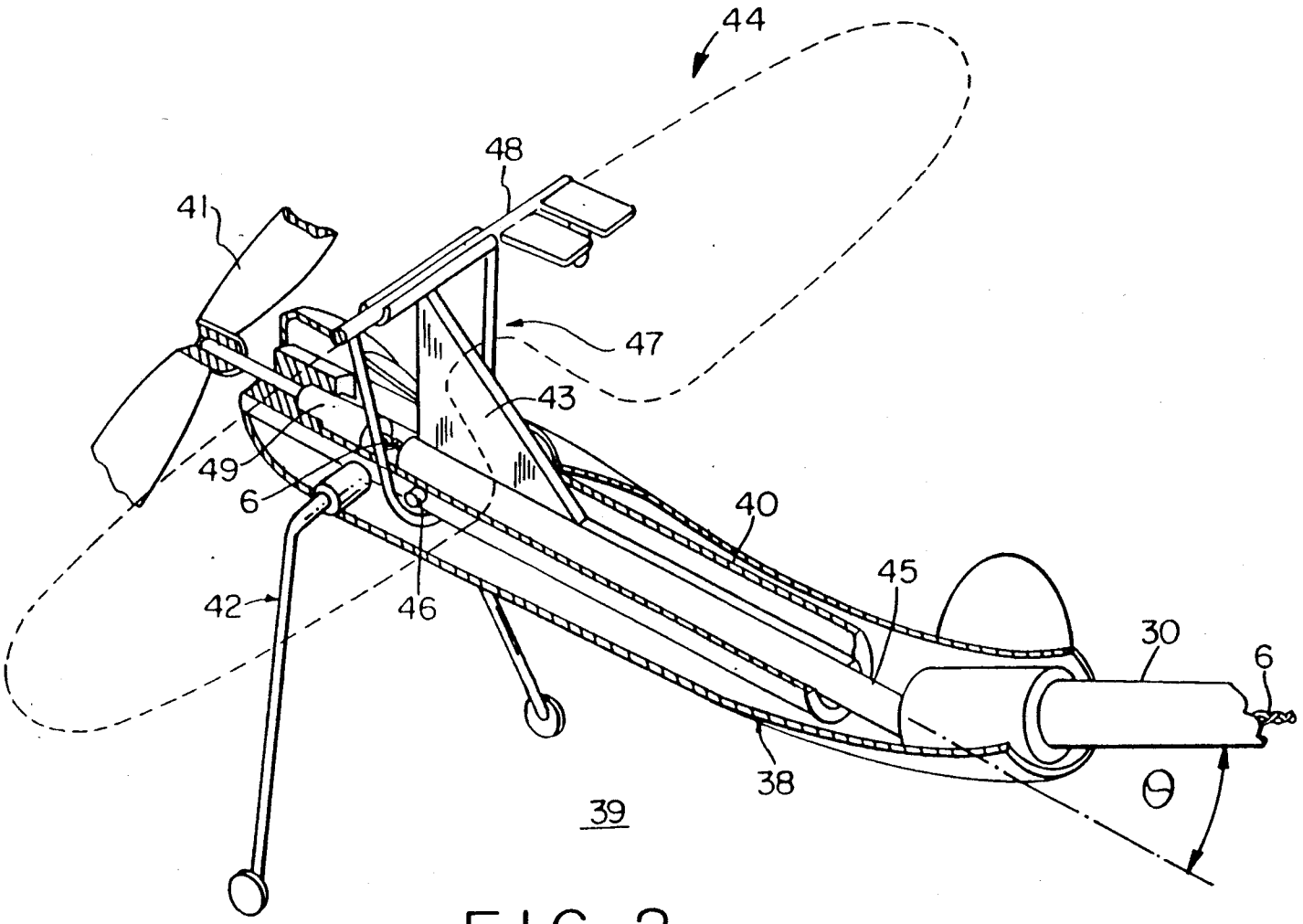
FIG. 2 is a side elevational view of a model airplane that may be used as the tether controlled flying toy.
Figure 3:
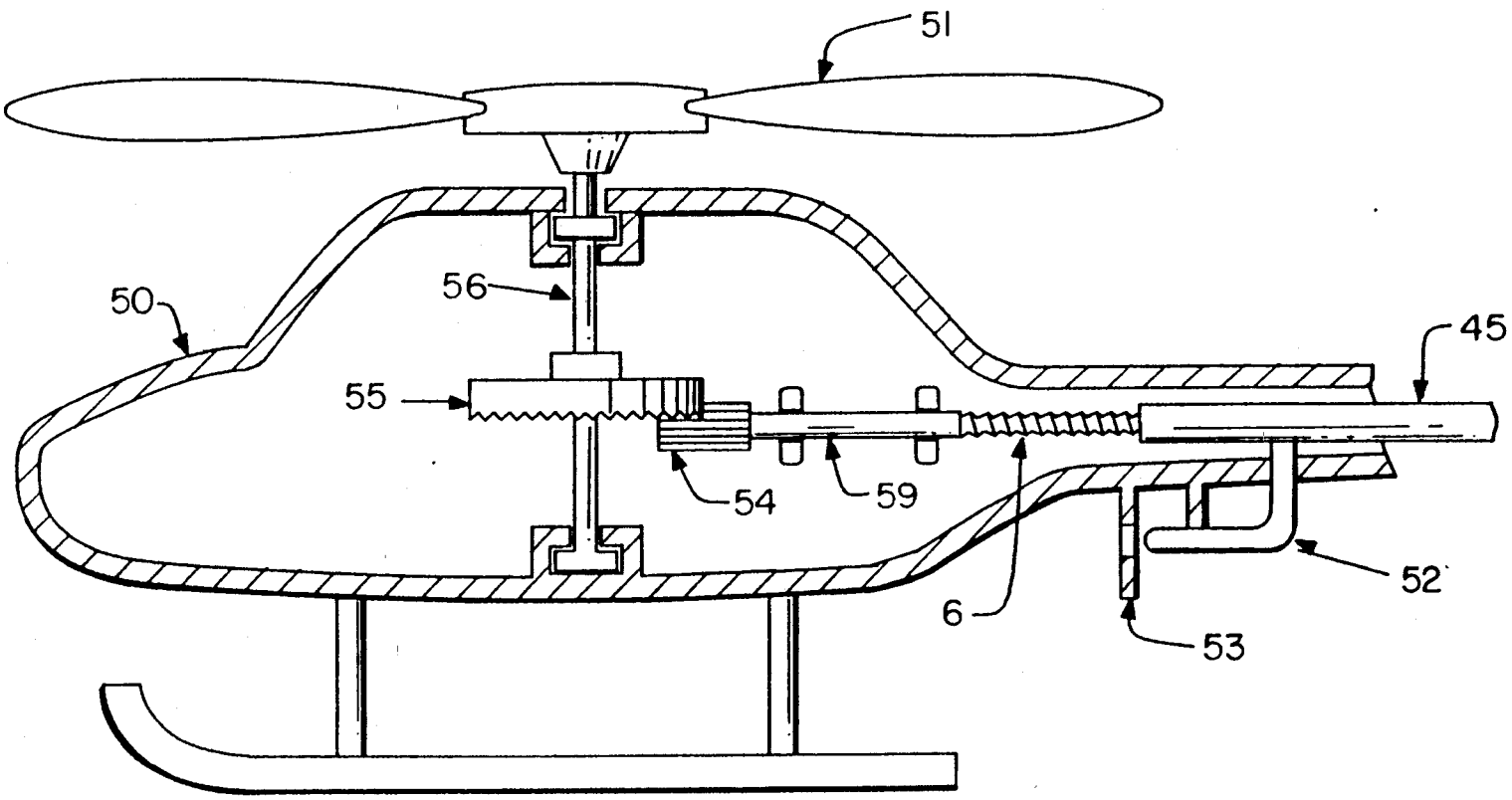
FIG. 3 is a cross sectional side view of a model helicopter that may be used as the tether controlled flying toy.

Referring to FIG. 2, the airplane 39 comprises a hollow fuselage 40, a propeller 41 rotatably attached to the front of the fuselage 40, landing gear 42 depending downwardly from the fuselage 40, a hollow connecting tube 45 and wings 44. The hollow connecting tube 45 connects to the hollow tethering means 30 at the rear of the fuselage 40 at an angle Θ and is slidably mounted inside the fuselage 40. Wings 44 are pivotally mounted above the fuselage 40 and the hollow connecting tube 45 by a mounting structure 43. Mounting structure 43 is rigidly attached or integrally formed to the upper surface of the hollow connecting tube 45.

Extending outwardly from either side of fuselage 40, just behind the landing gear 42, is a pair of holding pegs 46 that act together with landing gear 42 as stops for rails 47. Rails 47 are attached to the pivoting wing support bar 48. Landing gear 42, pegs 46, rails 47 and wing support bar 48 all function to control the angle of wings 44, which will be described in greater detail below.

The rotating tethering means 6 extends from the motor 2, through the opening in shaft 11, through the hollow tethering means 30, and through the hollow connecting tube 45 before connecting to the propeller 41. In a preferred embodiment the rotating tethering means 6 is connected to the propeller 41 by a connecting sleeve 49. Preferably connecting sleeve 49 is made of aluminum. The rotating tethering means 6 causes propeller 41 to rotate in accordance with the rotation of motor 2.

When propeller 41 has reached the appropriate rotational speed the airplane 39 becomes airborne due to the flow of air across wings 44. The altitude of airplane 39 is controlled by adjusting the angle of the wings 44. The angle of the wings 44 can be controlled from the control means 1 by moving lever 20.

Specifically, moving lever 20 causes clutch assembly 5 to move toward the front or rear of the control means 1. The hollow tethering means 30 is attached to the clutch assembly 5 and moves in accordance with the movement of clutch assembly 5. The hollow connecting tube 45, which is attached to the hollow tethering means 30, also moves in the same direction as clutch assembly 5. When the hollow connecting tube 45 is moved towards the rear of fuselage 40 (by moving lever 20 toward the front of control means 1) landing gear 42 and holding pegs 46 brace rails 47, and prevent rails 47 from moving with the hollow connecting tube 45 and mounting structure 43 that is attached to the hollow connecting tube 45. The bracing of rails 47 causes the wing support bar 48 to pivot downwardly resulting in wings 44 being angled downwardly.

Similarly, when the hollow connecting tube 45 and mounting structure 43 move toward the front of the fuselage 40 (by moving lever 20 toward the rear of control means 1) landing gear 42 and holding pegs 46 brace rails 47 and prevent rails 47 from moving with the hollow connecting tube 45 and mounting structure 43. The result is that the wing support bar 48 pivots upwardly thereby angling wings 44 upwardly.

Once airplane 39 is airborne, the operator can control the direction of the airplane by moving lever 10 of control means 1. Specifically, by moving lever 10 to the right the operator will cause clutch assembly 5, the hollow tethering means 30, and the connecting tube 45 to rotate in a clockwise direction resulting in the airplane 39 moving to the right of the central axis of the control means 1. Similarly, by moving lever 10 to the left the operator will cause clutch assembly 5, the hollow tethering means 30 and the connecting tube 45 to rotate in a counter clockwise direction resulting in the airplane 39 moving to the left of the central axis of control means 1.

In a preferred embodiment the airplane 39 may further comprise a hollow covering 38 that surrounds the fuselage 40, connecting tube 45 and connecting means 49. The hollow covering 38 is preferably made of lightweight moldable plastic and is molded to the shape of an authentic airplane fuselage to provide the airplane with a realistic appearance. Hollow covering 38 has openings from which landing gear 42, rails 47 and mounting structure 43 extend.

Referring to FIG. 3, the flying toy may be a helicopter 49. The helicopter 49 comprises a body 50 with a propeller or rotor 51 mounted on the top of body 50, a hollow connecting tube 45 slidably mounted in the rear of body 50, a hook 52 rigidly attached or integrally formed to the bottom of the hollow connecting tube 45 and a hook reception device 53 depending downwardly from the rear of body 50. The hollow tethering means 30 connects to the hollow connecting tube 45, at the rear of body 50. The rotating tethering means 6 extends from the motor 2, through clutch assembly 5, through the hollow tethering means 30 and through the hollow connecting tube 45 before attaching to a horizontally mounted gear 54 within body 50 of the helicopter 49.

The rotating tethering means 6 can be attached to gear 54 by any means known in the art. Preferably rotating tethering means 6 attaches to gear 54 by sleeve 59 that may be made of any suitable material such as copper or aluminum.

Gear 54 is connected to gear 55, within body 50. Gear 55 is vertically mounted on drive shaft 56, also located within body 50 of the helicopter 49. Drive shaft 56 is connected to the rotor 51.

Rotor 51 is rotated by the interaction of gears 54 and 55 and the rotation of the rotating tethering means 6. The rotating tethering means 6 is rotated by the motor 2 within the control means 1.

The altitude of the helicopter is controlled by adjusting the speed of rotation of the rotor 51. The rotation speed of rotor 51 is controlled by the amount of power supplied to motor 2. The power is preferably controlled through the use of a variable switch 3.

Once the helicopter 49 is airborne, the operator may control the direction of the helicopter 49 with lever 10. The direction control procedure is similar to that described above for the airplane 39.

The hollow connecting tube 45 is moveable toward the front or rear of the helicopter 49 by use of lever 20 as described above for the airplane 39. The movement of the hollow connecting tube 45 toward the rear of the helicopter 49 causes the hook 52 to disengage from the hook reception device 53 and thereby release any cargo or payload that the helicopter may carry. When the connecting tube 45 is moved toward the front of the helicopter 49 or is returned to the normal operating position, hook 52 engages the hook reception device 53 thereby securely holding any cargo or payload that the helicopter may carry.

The above mentioned patents, publications, and test methods are incorporated herein by reference.

Many variations in the present invention will suggest themselves to those skilled in the art in light of the above, detailed description. All such obvious modifications are within the full intended scope of the appended claims.

What is claimed is:

1. A tethered control flying toy comprising:

(a) a flying toy;

(b) a hand held control means for controlling the flying toy comprising a housing and contained therein: a power source, a motor, a switch to control power to the motor, a means for rotating a hollow tethering means about a central axis of the control means, a means for displacing a hollow tethering means in a direction parallel to the central axis of the control means;

(c) a hollow tethering means attaching the flying toy to the control means;

(d) a rotating tethering means located within the hollow tethering means connecting a propeller of the flying toy to the motor in the control means; and (e) a clutch assembly means for adjusting the orientation of hollow tethering means and the flying toy with respect to said housing.

2. A tethered controlled flying toy as defined in claim 1, wherein the flying toy is an airplane comprising: a propeller attached to the rotating tethering means, a hollow fuselage connected to the propeller at one end and the hollow tethering means at the other end; and a wing structure attached to the fuselage.

3. A tethered controlled flying toy as defined in claim 2 wherein the hollow tethering means attaches to the fuselage at an angle of about 10° to about 45°.

4. A tethered controlled flying toy as defined in claim 3 wherein the hollow tethering means attaches to the fuselage at angle of about 15° to about 25°.

5. A tethered controlled flying toy as defined in claim 4 wherein the hollow tethering means attaches to the fuselage at an angle of about 20°.

6. A tethered controlled flying toy as defined in claim 2 wherein the means for rotating the hollow tethering means rotates the hollow tethering means in a clockwise or counter clockwise direction causing the airplane to rotate to the right or left of the central axis of the control means.

7. A tethered control flying toy as defined in claim 6 wherein the means for moving the hollow tethering means in a parallel direction controls the angle of the wings of the airplane causing the airplane to move upwardly or downwardly.

8. A tethered controlled flying toy as defined in claim 1 wherein the flying toy is a helicopter comprising: a body attached to the end of the hollow tethering means opposite the end attached to the control means, a propeller located on the top of the body and a means for rotating the propeller that is attached to the end of the rotating tethering means opposite the end attached to the motor.

9. A tethered controlled flying toy as defined in claim 8 wherein the means for rotating the hollow tethering means rotates the hollow tethering means clockwise or counter clockwise direction with respect to the central axis of the control means, causing the helicopter to move to the left or right of the central axis of the control means.

10. A tethered controlled flying toy as defined in claim 8 wherein the helicopter further comprises a means for releasably carrying a payload.

11. A tethered controlled toy helicopter comprising:

(a) a hand held control means for controlling the helicopter comprising a housing and contained therein: a power source, a motor, a switch to control power to the motor, a means for rotating a hollow tethering means about a central axis of the control means, a means for displacing a hollow tethering means in a direction parallel to the central axis of the control means, (b) a hollow tethering means attaching the helicopter to the control means;

(c) a rotating tethering means located within the hollow tethering means connecting a propeller of the helicopter to the motor in the control means;

(d) a clutch assembly means for adjusting the orientation of the hollow tethering means and the toy helicopter with respect to said housing; and (e) a flying helicopter toy comprising: a body attached to the end of the hollow tethering means opposite the end attached to the control means, a propeller located on the top of the body, a means for rotating the propeller that is attached to the end of the rotating tethering means opposite the end attached to the motor, and a means for releasably carrying a payload wherein the means for displacing the hollow tethering means in a direction parallel to the central axis of the control means, controls the means for releasably carrying a payload.

12. A tethered controlled flying toy as defined in claim 1 wherein the switch is a variable resister that controls the amount of power to the motor.

* * * * *